US008869739B2

(12) United States Patent
Pfaffenroth et al.

(10) Patent No.: US 8,869,739 B2
(45) Date of Patent: Oct. 28, 2014

(54) WHEEL COATING METHOD AND APPARATUS FOR A TURBINE

(75) Inventors: Timothy James Pfaffenroth, Greenville, SC (US); Glen Aussiker, Hillsboro, TN (US); Gregory Brown, Greenville, SC (US); Nikhil Bhat, Framingham, MA (US)

(73) Assignee: General Electric Company, Schenectady, NY (US)

( * ) Notice: Subject to any disclaimer, the term of this patent is extended or adjusted under 35 U.S.C. 154(b) by 388 days.

(21) Appl. No.: 13/284,535

(22) Filed: Oct. 28, 2011

(65) Prior Publication Data

US 2013/0108791 A1 May 2, 2013

(51) Int. Cl.
*B05C 11/11* (2006.01)
*B05D 1/32* (2006.01)
*F01D 5/28* (2006.01)

(52) U.S. Cl.
CPC ..... *F01D 5/288* (2013.01)
USPC ..... 118/505; 118/504; 427/282

(58) Field of Classification Search
CPC ..... B29C 7/00; B05C 11/00; B05D 5/00; B05D 7/00
USPC ..... 427/282; 118/504, 505; 264/241
See application file for complete search history.

(56) References Cited

U.S. PATENT DOCUMENTS

| | | | | |
|---|---|---|---|---|
| 3,862,047 | A | 1/1975 | Weltman et al. | |
| 4,019,875 | A | 4/1977 | Dittrich et al. | |
| 5,626,781 | A | 5/1997 | Schmidt et al. | |
| 5,867,762 | A * | 2/1999 | Rafferty et al. | 428/548 |
| 7,632,541 | B2 * | 12/2009 | Saylor et al. | 427/248.1 |

* cited by examiner

*Primary Examiner* — Nathan Empie
*Assistant Examiner* — Xiao Zhao
(74) *Attorney, Agent, or Firm* — Nixon & Vanderhye P.C.

(57) ABSTRACT

Prior to instrumenting a turbine wheel for component and developmental testing, a protective coating is applied to the turbine wheel so that sensors can be welded to the coating rather than to the base material of the turbine wheel. But it is important to prevent the dovetail slots, which are critical to the usable life of the turbine wheel, from being coated. Plugs are provided that can be inserted into the dovetail slots prior to applying the coating. Each plug is shaped to match the shape profile of the dovetail slot. The plug prevents critical areas from being coated, removes the need for post processing, and allows a single coating to be applied.

20 Claims, 10 Drawing Sheets

WHEEL COATING METHOD AND APPARATUS FOR A TURBINE

The present invention relates generally to turbo machines. In particular, one or more aspects of the present invention relate to method and apparatus to apply protective coating to gas turbine wheels.

BACKGROUND OF THE INVENTION

Turbines generally include a rotor comprised of a plurality of rotor turbine wheels, each of which mounts a plurality of circumferentially-arranged buckets. Each bucket includes an airfoil, a platform, a shank and a dovetail, the dovetail being received in mating dovetail slot in the turbine wheel. The airfoils project into a hot gas path downstream of the turbine combustors and convert kinetic energy into rotational, mechanical energy.

Often, a protective coating is applied to the turbine wheel for various purposes. For example, the turbine wheel can be instrumented for component and developmental testing (CDT). In CDT, sensors or instruments are attached to the turbine wheel—often by resistance welding the sensors to the turbine wheel. Rather than resistance welding the sensors directly to the turbine wheel itself, a nickel-chromium (NiCr) coating can be applied to the turbine wheel using a plasma spray for example. The sensors then can be welded to the protective coating. In this way, the turbine wheel can be instrumented without inducing or creating stress risers into the base/parent material of the turbine wheel.

However, it is necessary to prevent the dovetail slots from being coated. The slots, which are critical to the usable life of the turbine wheel, are machined to a precisely shaped profile and surface finish. Complementarily shaped dovetails (also precisely machined) of the buckets are mated with the slots for assembly of the turbine. Due in large part to the precise machining of the dovetails and slots, the usable life of the turbine would be compromised if the slots are coated. The coating can be removed, but the removal process generally requires an abrasive device, which disturbs the surface finish. Any disturbance of the dovetail surface can decrease the usable life of the turbine wheel and negate any applied metal treatments such as shotpeen.

Prior attempts to prevent the slots from being coated included using high temperature adhesive tapes to mask off the dovetail slots and other critical areas. This is a labor intensive and a time consuming process. Also, the tapes can create sharp edges that can result in coating chipping and flaking which requires extensive detail and blending post processing to remove such defects. In addition, the plasma spray is applied at high pressures, such as at 90 PSI. This can cause the tape to lift allowing overspray to come in contact with the dovetail surface.

Thus, it is desirable to provide a method and a device to apply protective coating with a greater control of pattern definition, coating surface finish, and to eliminate or vastly reduce incidences of process damage and the necessary rework that follows such incidences.

BRIEF SUMMARY OF THE INVENTION

A non-limiting aspect of the present invention relates to a dovetail plug adapted to be inserted into a dovetail slot of a turbine wheel. The plug comprises an insertion part and a protrusion part. The insertion part is shaped to be axially inserted into the dovetail slot from a turbine wheel face to a predetermined insertion depth when the plug is fully inserted into the turbine wheel, and the protrusion part is shaped to axially protrude from the turbine wheel face when the plug is fully inserted into the turbine wheel. The protrusion part comprises a blast portion connected to the insertion part, and a shadow portion on outside of the blast portion. The shadow portion is such that a first contour of the shadow portion is defined at the turbine wheel face and a second contour of the shadow portion is defined at a predetermined protrusion distance from the turbine wheel face. The second contour is outside of the first contour. A shadow surface is a surface of the shadow portion between the first and second contours, and a shadow angle formed between the shadow surface and the turbine wheel face is less than a right angle.

Another non-limiting aspect of the present invention relates to a method of forming a dovetail plug to be inserted into a dovetail slot of a turbine wheel. The method comprises forming an insertion part in a shape to be axially inserted into the dovetail slot from a turbine wheel face to a predetermined insertion depth when the plug is fully inserted into the turbine wheel. The method also comprises forming a protrusion part in a shape to axially protrude from the turbine wheel face when the plug is fully inserted into the turbine wheel. The step of forming the protrusion part comprises forming a blast portion connected to the insertion part and forming a shadow portion on outside of the blast portion. The shadow portion is formed such that a first contour of the shadow portion is defined at the turbine wheel face and a second contour of the shadow portion is defined at a predetermined protrusion distance from the turbine wheel face. The second contour is outside of the first contour. A shadow surface is a surface of the shadow portion between the first and second contours, and a shadow angle formed between the shadow surface and the turbine wheel face is less than a right angle.

Another non-limiting aspect of the present invention relates to a method of applying protective coating to a turbine wheel. The method comprises inserting plugs into dovetail slots of a turbine wheel, and subsequently applying the protective coating on the turbine wheel. Each plug inserted into the dovetail slots comprises an insertion part and a protrusion part. The insertion part is shaped to be axially inserted into the dovetail slot from a turbine wheel face to a predetermined insertion depth when the plug is fully inserted into the turbine wheel, and the protrusion part is shaped to axially protrude from the turbine wheel face when the plug is fully inserted into the turbine wheel. The protrusion part comprises a blast portion connected to the insertion part, and a shadow portion on outside of the blast portion. The shadow portion is such that a first contour of the shadow portion is defined at the turbine wheel face and a second contour of the shadow portion is defined at a predetermined protrusion distance from the turbine wheel face. The second contour is outside of the first contour. A shadow surface is a surface of the shadow portion between the first and second contours, and a shadow angle formed between the shadow surface and the turbine wheel face is less than a right angle.

BRIEF DESCRIPTION OF THE DRAWINGS

These and other features of the present invention will be better understood through the following detailed description of non-limiting example embodiments in conjunction with the accompanying drawings, in which.

DETAILED DESCRIPTION OF THE INVENTION

Novel plug for use when applying a protective coating on a turbine wheel is described. Methods of forming as well as using the plug are also described.

Figure 1:
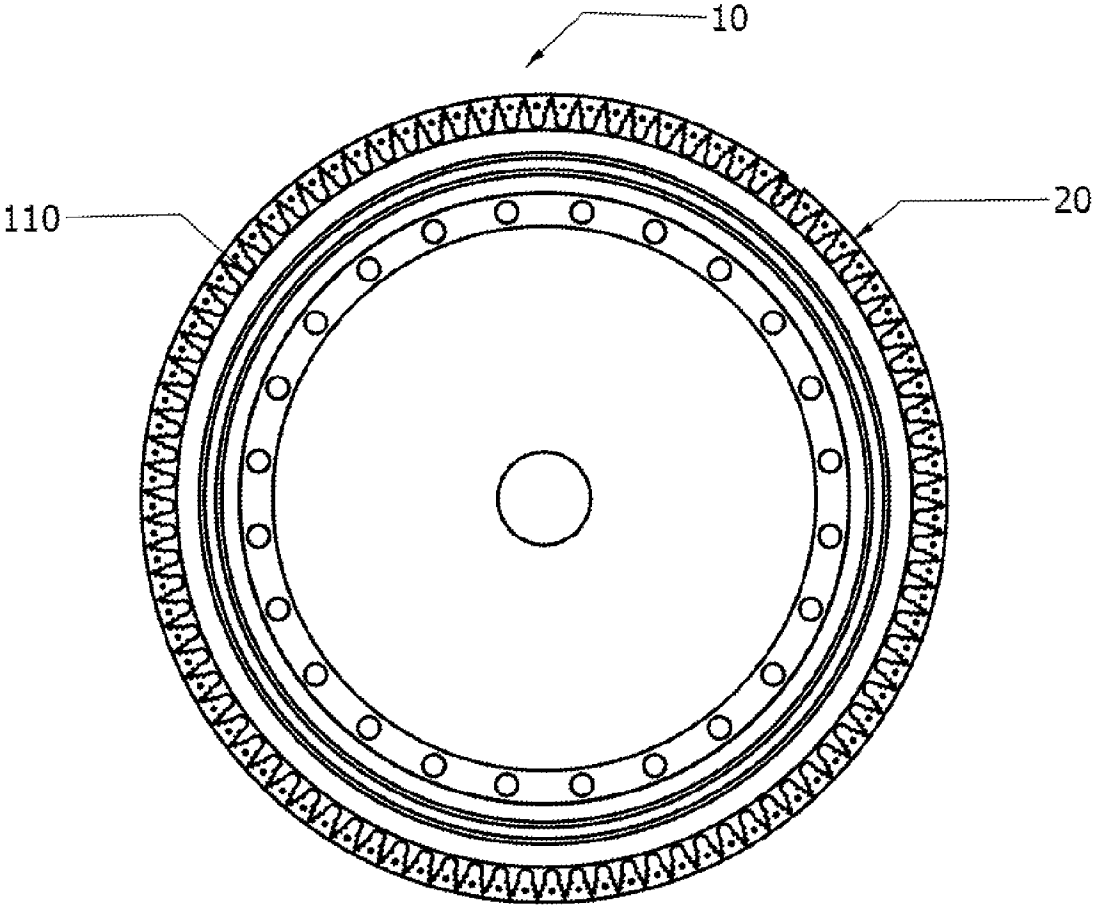
FIG. 1 illustrates an example turbine wheel with a plurality of plugs inserted into corresponding dovetail slots.
Figure 2:
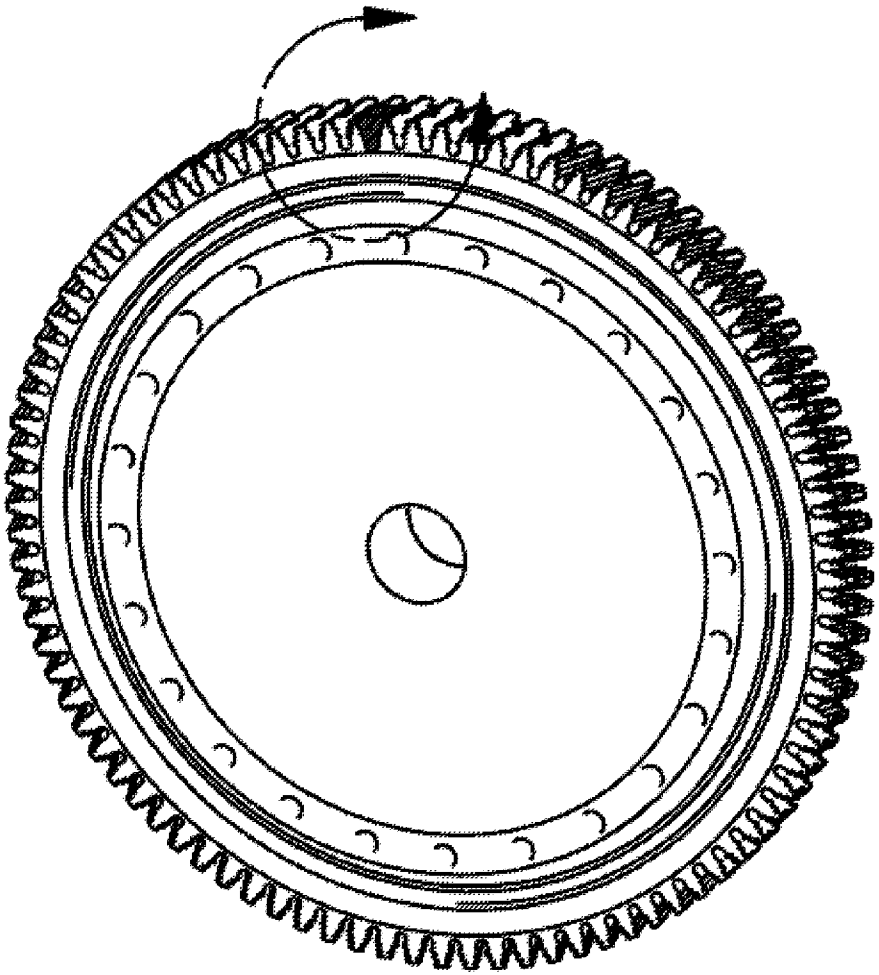
FIG. 2 illustrates a perspective view of a plug inserted into a turbine wheel.
Figure 3:
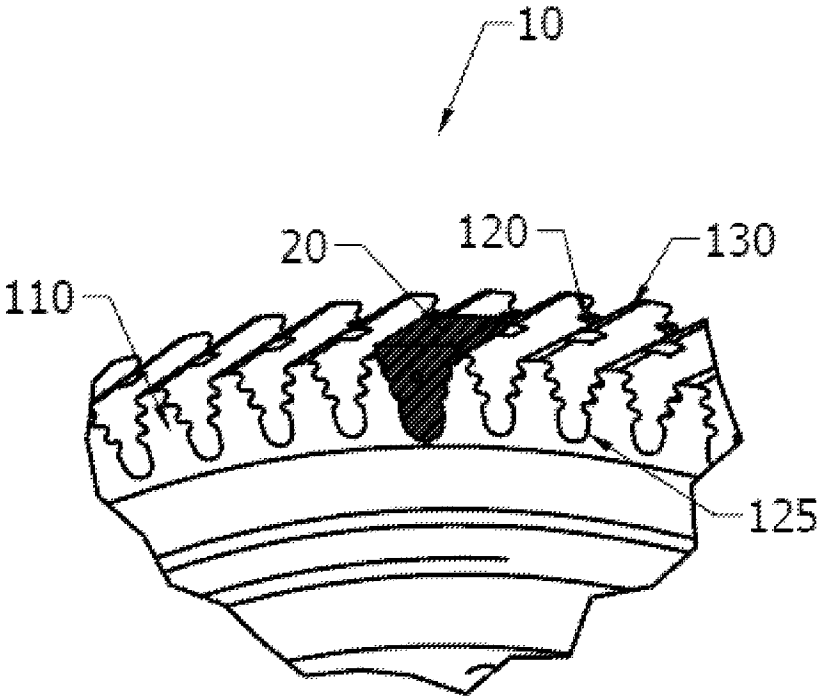
FIG. 3 illustrates a more detailed perspective view of a plug inserted into a dovetail slot of a turbine wheel.

FIG. 1 illustrates an example turbine wheel 10 with a plurality of plugs inserted 20 into corresponding dovetail slots. FIG. 1 is an axial view of the wheel 10 towards the turbine wheel face 110. FIG. 2 illustrates a perspective view of a plug 20 inserted into the turbine wheel 10, and FIG. 3 illustrates a more detailed view of the inserted plug 20 and corresponds to the circled portion in FIG. 2. In this particular embodiment, the plug 20 is shaped to match the contour of the dovetail slots 120. When fully inserted, the plug 20 covers at least a part of the circumferential surface 130 of the turbine wheel 10.

Figure 5:
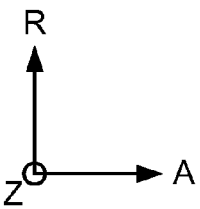
FIG. 5 illustrates a circumferential view of a cross-section of the plug illustrated in FIG. 4 along a line 'j'-'j'.
Figure 5:
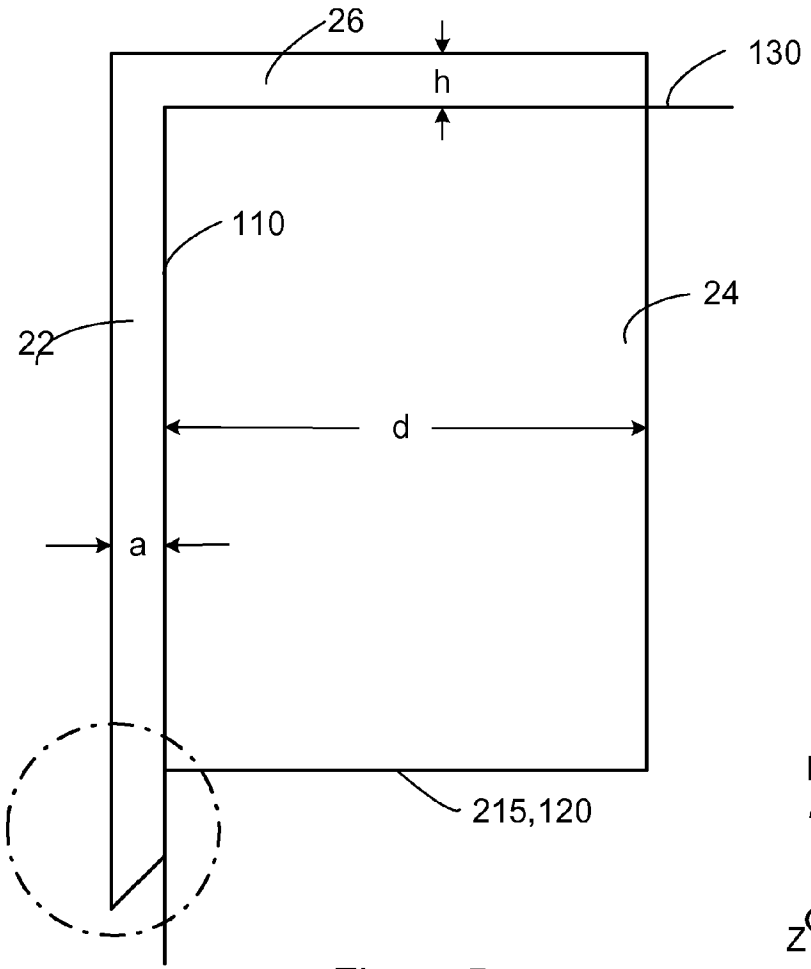

As seen in FIG. 5, when the plug 20 is fully inserted, the plug 20 is shaped such that a part of the plug 20 still protrudes a distance 'a' axially from the turbine wheel face 110, and is referred to as the protrusion part 22 in this document. The part of the plug 20 that is inserted to the predetermined depth 'd' is referred to as the insertion part 24. Thus, the insertion part 24 can be said to be shaped to be axially inserted into the dovetail slot 120 from the turbine wheel face 110 to the predetermined insertion depth 'd' when the plug 20 is fully inserted into the turbine wheel 10.

Figure 4:
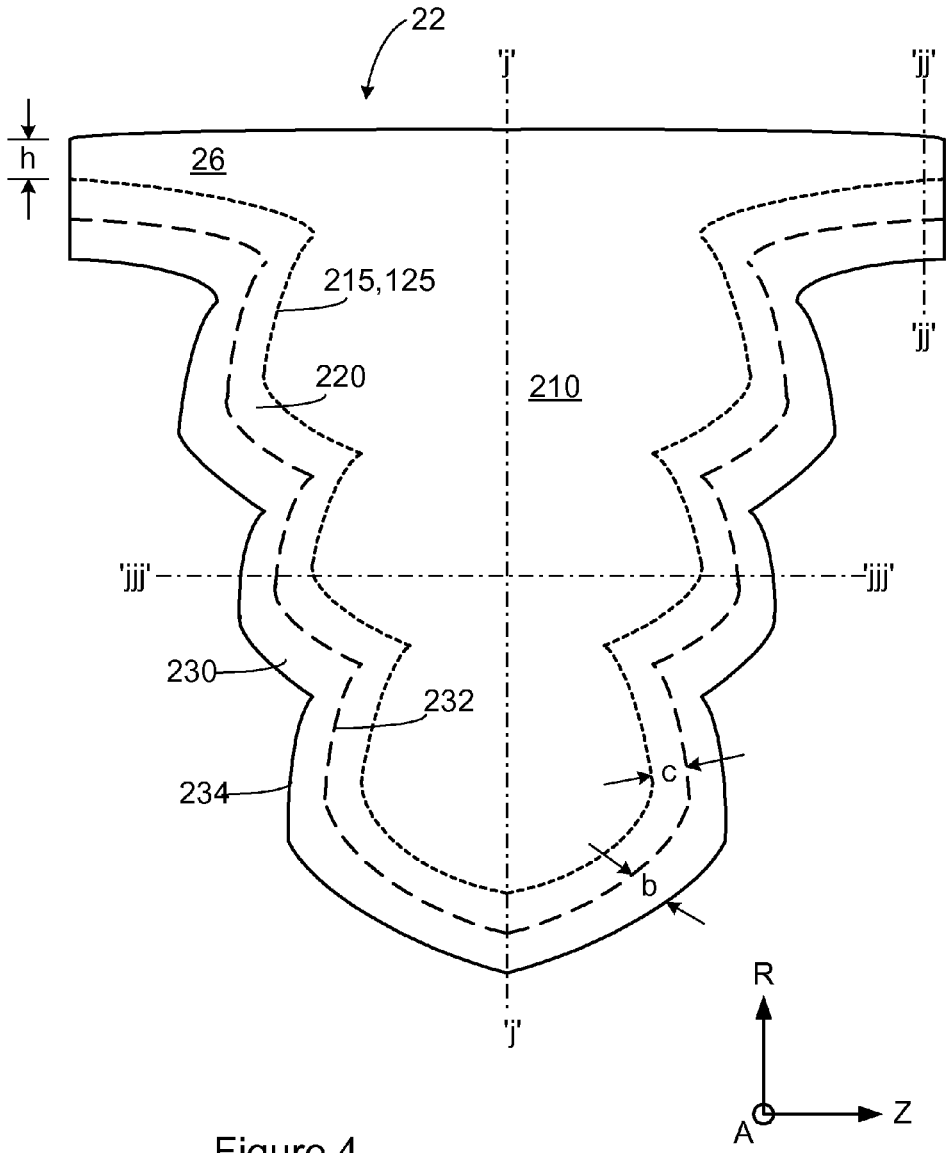
FIG. 4 illustrates an axial view of a plug according to a non-limiting embodiment of the present invention.

FIG. 4 is an axial view of the plug 20 as indicated by reference coordinate direction arrows R (radial), Z (circumferential), and A (axial). In this figure, the axial coordinate reference 'A' is circled to indicate that the axial direction is into the page. In particular, FIG. 4 is an axial view of the protrusion part 22. As seen, the protrusion part 22 includes a central blast portion 210 and a shadow portion 230 on the outside of the blast portion 210. The shadow portion 230 is bounded by the first contour 232 (long dashed line) and a second contour 234 (solid line). The first contour 232 would not necessarily be visible when viewing the protrusion part 22. It is drawn in FIG. 4 to demarcate the different portions of the plug 20 for explanatory purposes. As seen, the second contour 234 is outside of the first contour 232. Distance 'b' between the first and second contours 232, 234 represents a width of the shadow portion 230.

Before proceeding further, the following should be noted. For explanatory purposes, the plug 20 is described being comprised of the protrusion and insertion parts 22, 24 and the protrusion part 22 itself is described as including various portions, the separation of the plug 20 into various parts and portions is for ease of explanation. But it is fully envisioned that the parts and portions of the actual plug 20, at least in one aspect, are integrally formed as one piece, for example, through a molding process.

Figure 6:
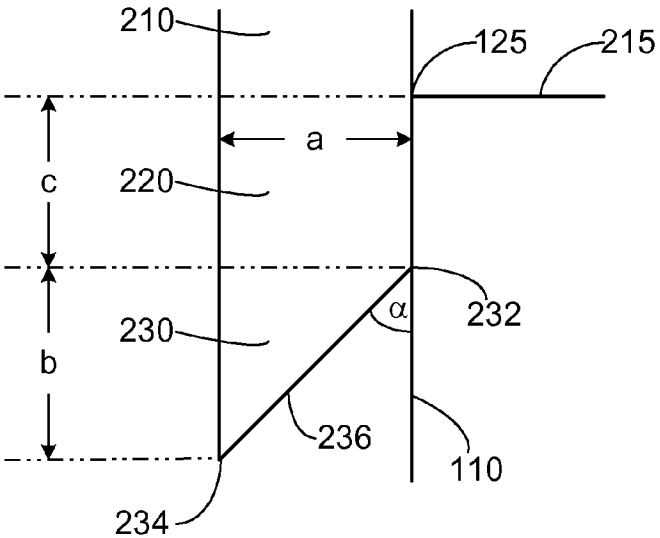
FIG. 6 illustrates a detailed view of a circled portion in FIG. 5.

FIG. 5 illustrates a circumferential view of the plug 20 as indicated by reference coordinate direction arrows in which circumferential reference direction Z is circled. In particular, FIG. 5 is a view of a cross-section of the plug 20 taken along a line a line 'j'-'j' in FIG. 4. FIG. 6 is a detailed view of the circled portion in FIG. 5. As seen in these figures, the first contour 232 is a contour of the shadow portion 230 at the turbine wheel face 110, and the second contour 234 is a contour of the shadow portion 230 at a predetermined protrusion distance from the turbine wheel face 110. As noted above, the second contour 234 is outside of the first contour 232 when viewed axially.

The surface of the shadow portion 230 between the first and second contours 232 and 234 is referred to as the shadow surface 236, which forms a shadow angle $\alpha$ with the turbine wheel face 110 as seen in FIG. 6. In one embodiment, it is preferred that the shadow angle $\alpha$ be less than 90°, i.e., be less than a right angle.

The shadow angle $\alpha$ being less than the right angle is beneficial for at least the following reason. When the protective coating is sprayed, the shadow portion 230 prevents protective coating with sharp edges, i.e., abrupt changes in coating thickness, from being formed. Instead, coatings with gradual thickness transitions are formed in between the shadow surface 236 and the turbine wheel face 110. This removes the need for post processing to profile the protective coating. In addition, because the gradual thickness transitions are possible, a single coating of sufficient thickness may be applied rather than the traditional method of applying multiple coats. This saves both time and money.

It should be noted that the predetermined protrusion distance of the second contour 234 need not be all the way at the thickness 'a' of the protrusion part 22. The second contour 234 need only be defined at some distance away from the turbine wheel face 110, even if less than 'a', so that the shadow surface 236 forms the proper angle $\alpha$ with the turbine wheel face 110. Any combination of the predetermined distance protrusion distance of the second contour 234, the thickness 'b' of the shadow portion 230, and the shadow angle $\alpha$ may be adjusted depending on the circumstances. For the remainder of this document, it is assumed that the second contour 234 is the contour of the shadow portion 230 at distance 'a' for convenience.

Preferably, the shape profile of the plug 20 is consistent throughout so that the protection from the coating process can be consistently maintained. This can be achieved by shaping the plug 20 to have various characteristics. As an example, it is preferred that the angle $\alpha$ be substantially constant over an entirety of the shadow surface 236.

Figure 7:
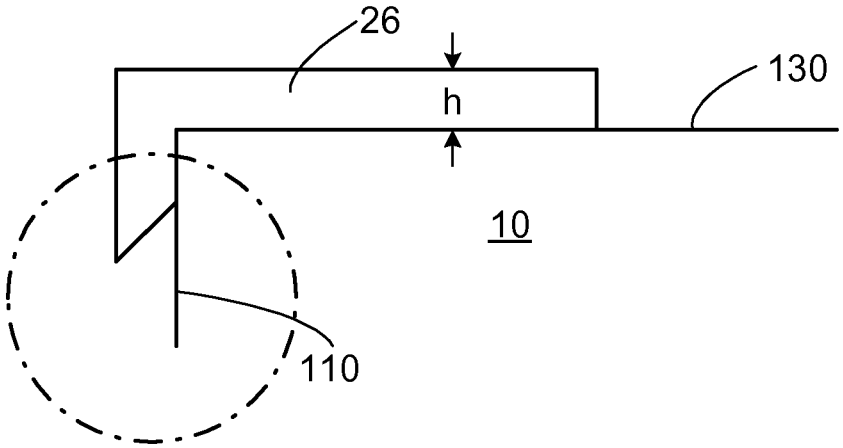
FIG. 7 illustrates a circumferential view of a cross-section of the plug illustrated in FIG. 4 along a line 'jj'-'jj'.
Figure 8:
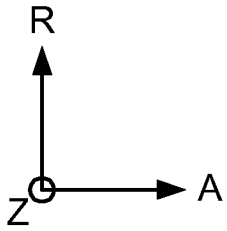
FIG. 8 illustrates a detailed view of a circled portion in FIG. 7.
Figure 8:
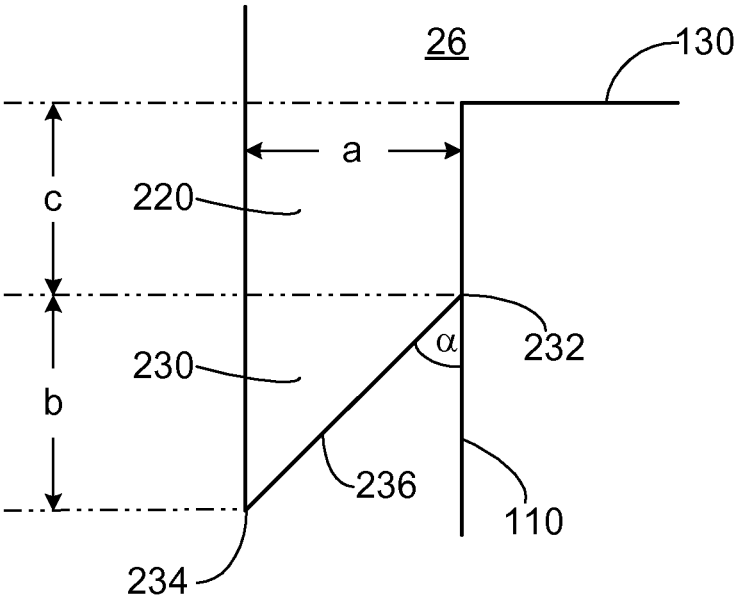

FIG. 7 illustrates a circumferential view of another cross-section of the plug 20, this time along a line 'jj'-'jj' in FIG. 4, and FIG. 8 is a detailed view of the circled portion in FIG. 7. While FIG. 6 illustrates a cross section of the plug 20 near a center thereof, FIG. 7 illustrates a cross section of the plug 20 near an end thereof. Nonetheless, as seen in FIG. 7, the shadow portion 230 is formed such that the shadow surface 236 forms a shadow angle that is substantially the same angle $\alpha$ as in FIGS. 5 and 6. In addition, the width 'b' of the shadow portion 230, the predetermined protrusion distance of the second contour 234, and a distance 'c' from the dovetail slot edge 125 to the first contour 232 are substantially the same as in FIGS. 7 and 8.

Figure 9:
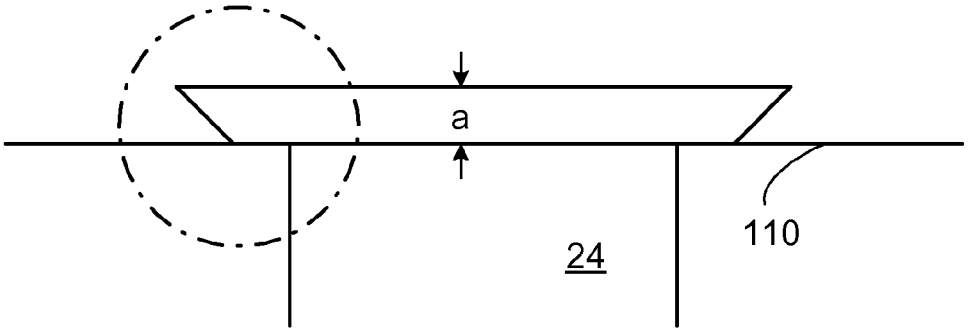
FIG. 9 illustrates a radial view of a cross-section of the plug illustrated in FIG. 4 along a line 'jjj'-'jjj'.
Figure 9:
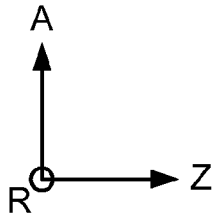
Figure 10:
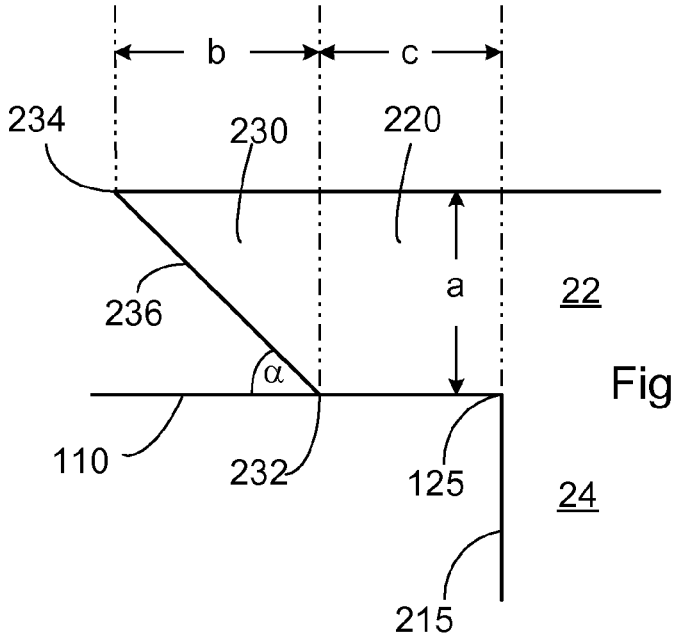
FIG. 10 illustrates a detailed view of a circled portion in FIG. 9.

FIG. 9 illustrates a radial view of a cross-section of the plug illustrated in FIG. 4 along a line 'jjj'-'jjj', and FIG. 10 is a detailed view of the circled portion in FIG. 9. Again, it is seen that the shadow portion 230 is formed such that the shadow angle α, the width 'b', the predetermined protrusion distance of the second contour 234, and the distance 'c' are substantially the same as in FIGS. 5, 6, 7 and 8.

Figure 11:
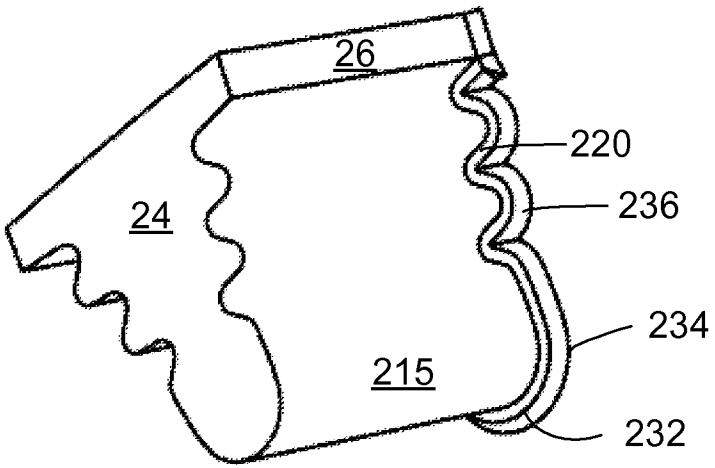
FIG. 11 illustrates perspective views of a plug according to a non-limiting embodiment of the present invention.
Figure 11:
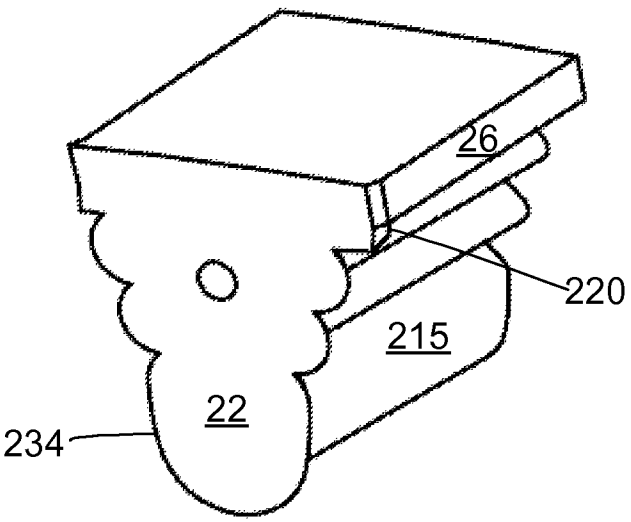

It suffices to say that when possible, some or all of the predetermined protrusion distance of the second contour 234, the width 'b' of the shadow portion 230, the distance 'c', and the shadow angle α are preferred to be substantially constant throughout. FIG. 11 illustrates perspective views of the plug 20. Note that throughout the plug 20, consistent shape profile is maintained.

It is also preferred that the shape of the dovetail slots 120 be followed so that as much of the surface of the turbine wheel 110 can be protected. Regarding the insertion part 24, it is indicated above that the insertion part 24 is shaped to be axially inserted into the dovetail slot 120. Referring back to FIG. 4, reference numeral 215 represents a contour of the insertion part 24. It is preferred that the insertion part contour 215 match the contour of the dovetail slot 120 along at least a part of the predetermined insertion depth 'd'. In FIG. 11, it is seen that the insertion part contour 215 is shaped to match the contour of the dovetail slot 120 along an entirety of the predetermined insertion depth 'd'.

As seen in FIG. 3, reference numeral 125 represents an edge the contour of the dovetail slot 120 at the turbine wheel face 110. In an embodiment, the first contour 232 is at or outside the dovetail slot edge 125. In FIG. 4, the first contour 232 is shown to be outside the insertion part contour 215, which in turn coincides with the dovetail slot edge 125. Thus, FIG. 4 is an example of the first contour 232 being outside of the dovetail slot edge 125.

While not shown, it can also be that the first contour 232 and the dovetail slot edge 125 match, i.e., the distance 'c' can be zero. But as long as the first contour 232 is at or outside the dovetail slot edge 125, the dovetail slot 120 will not be coated. It is also preferable that the second contour 234 follow the outline of the dovetail slot edge 125. That is, an offset from the dovetail slot edge 125 to the second contour 234 (distance 'b' plus 'c') is preferred to be substantially constant.

Some engineering requirements dictate that an area of the turbine wheel face 110 near the slot edge 125, the so-called critical area, not be coated. Typically, these are high stress areas. Any damage or surface finish to such areas causes cracks to develop which in turn can leads to a failure in the dovetail slot allowing the "bucket", i.e., turbine blade to liberate from the gas turbine causing catastrophic failure.

The plug 20 in FIG. 4 includes a protection portion 220 in between the blast and shadow portions 210, 230. In this instance, it is assumed that the critical area is an area of the turbo turbine wheel face 110 within a critical distance 'c' from the dovetail slot edge 125. The first contour 232 is then outside of the insertion part contour 215 and is at least the critical distance 'c' from the dovetail slot edge 125. The protection portion 220 in this embodiment is shaped to cover the critical area of the turbine wheel face 110, which is the area from the dovetail slot edge 125 to the first contour 232 when the plug 20 is fully inserted into the turbine wheel 10. In FIGS. 5-10, the critical distance 'c' is more clearly illustrated.

Preferably, an offset from the dovetail slot edge 125 to the first contour 232 is substantially constant. That is, the first contour 232 should follow the outline of the dovetail slot edge 125. This offset should be at least the critical distance 'c' and most preferably at 'c'. This allows the maximum area of the turbine wheel face 110 to be protected while still meeting critical area requirement. This is a vast improvement over the conventional adhesive tape method in which it is difficult, and most certainly impracticable, to shape the tapes to match the shape of the dovetail slots 120. Also, the offset from the first contour 232 to the second contour 234 should be substantially constant, again to provide nice coating transitions.

Generally, if critical areas are required, then the first contour 232 is outside the dovetail slot edge 125, preferably at a constant distance 'c'. But on the other hand, if there is no critical area requirement, then the protection portion 220 need not be provided. If the protection portion 220 is not provided, then the first contour 232 can coincide with the dovetail slot edge 125. This again maximizes the area of the turbine wheel 110 being protected while at the same time, preventing the dovetail slot 120 from being coated.

In FIGS. 4, 5 and 7, it is seen that the plug 20 includes a flange part 26 connected to the insertion part 24 and to the protrusion part 22. The flange part 26 is shaped such that when the plug 20 is fully inserted into the turbine wheel 10, at least a part of the turbine wheel surface 130 along the predetermined insertion depth. The flange part 26 is at a height 'h' above the turbine wheel surface 130 when inserted.

Figure 12:
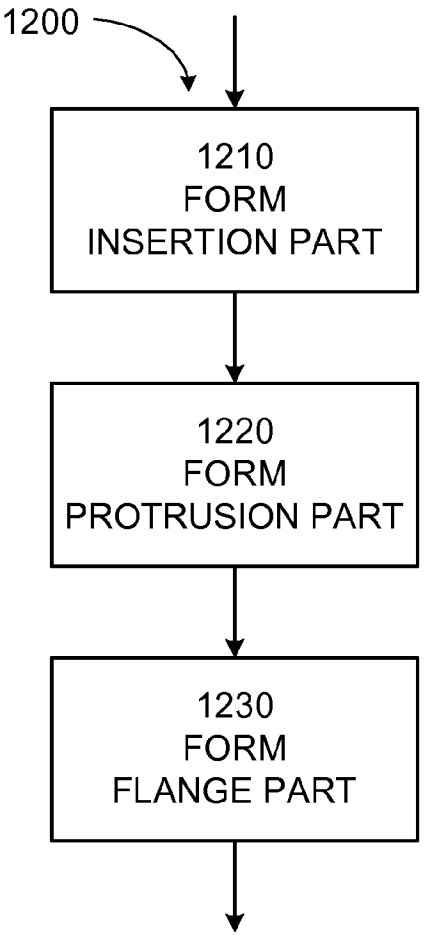
FIG. 12 illustrates a non-limiting example flow chart of a method to form a plug.

FIG. 12 illustrates a non-limiting example flow chart of a method 1200 to form the plug 20. In step 1210, the insertion part 24 of the plug 20 is formed in a shape to be axially inserted into the dovetail slot from a turbine wheel face to a predetermined insertion depth when the plug is fully inserted into the turbine wheel. In step 1220, the protrusion part 22 is formed in a shape to axially protrude from the turbine wheel face when the plug is fully inserted into the turbine wheel.

Figure 13:
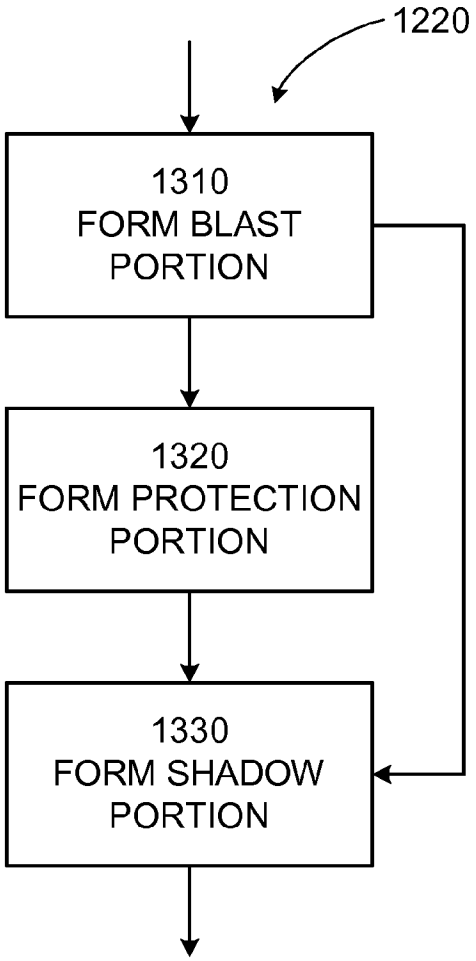
FIG. 13 illustrates a non-limiting example flow chart of a method to form a protrusion part of a plug.

FIG. 13 illustrates an example method to implement step 1220. In step 1310, the blast portion 210 is formed to be connected to the insertion part 24, the protection portion 220 is formed in step 1320, and the shadow portion 230 is formed in step 1330. If the protection portion 220 is not necessary, then only the steps 1310 and 1330 can be performed. As discussed above, the shadow portion 230 is formed such that the shadow angle formed between the shadow surface 236 and the turbine wheel face 110 is less than 90°. Other details of forming the plug 20 is straight forward from the detailed description of the plug 20 provided above with reference to FIGS. 4-10.

Figure 14:
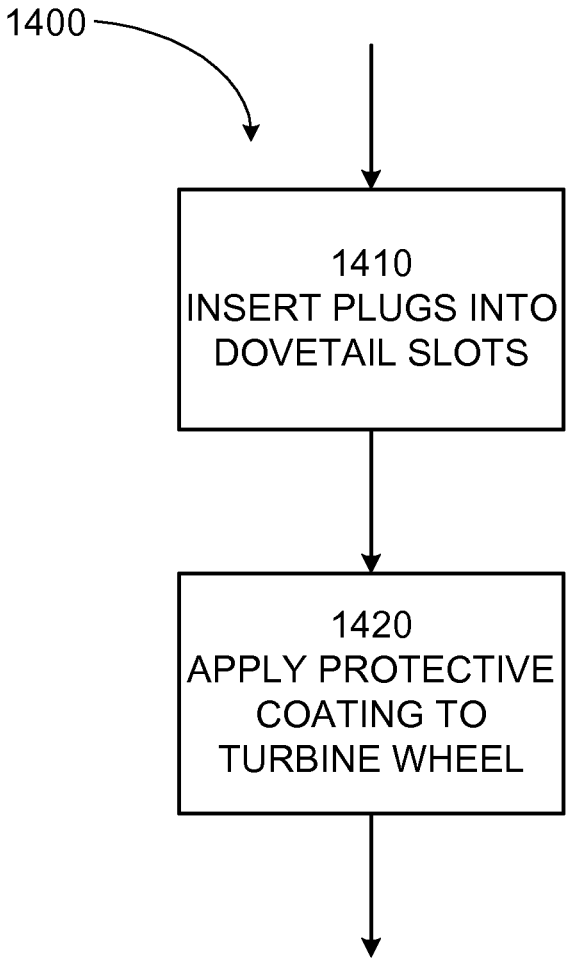
FIG. 14 illustrates a non-limiting example flow chart of a method to apply protective coating on a turbine wheel.

FIG. 14 illustrates a non-limiting example flow chart of a method 1400 to apply protective coating on the turbine wheel. In step 1410, the inventive plugs 20 as described above are inserted into the dovetail slots 120 of the turbine wheel 10. Subsequently, the protective coating is applied on the turbine wheel in step 1420.

Recall that due to the advantageous features of the plugs 20, there is no need to perform post processing to profile the protective coating. Also, in step 1420, a single coating may be applied. That is, multiple coating is not necessary.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A plug for insertion into a dovetail slot of a turbine wheel, the plug comprising:

an insertion part shaped to be axially inserted into the dovetail slot from a turbine wheel face to a predetermined insertion depth when the plug is fully inserted into the turbine wheel; and a protrusion part shaped to axially protrude from the turbine wheel face when the plug is fully inserted into the turbine wheel, wherein the protrusion part comprises:

a blast portion connected to the insertion part; and a shadow portion on outside of the blast portion, wherein a first contour of the shadow portion is defined at the turbine wheel face, wherein a second contour of the shadow portion is defined at a predetermined protrusion distance from the turbine wheel face, the second contour being outside of the first contour, wherein a shadow surface is a surface of the shadow portion between the first and second contours, and wherein a shadow angle formed between the shadow surface and the turbine wheel face is less than 90°.

2. The plug of claim 1, wherein the shadow angle is substantially constant over an entirety of the shadow surface.

3. The plug of claim 1, wherein an insertion part contour of the insertion part matches a contour of the dovetail slot along at least a part of the predetermined insertion depth.

4. The plug of claim 1, wherein the first contour is at or outside dovetail slot edge.

5. The plug of claim 4, wherein an offset from the dovetail slot edge to the second contour is substantially constant.

6. The plug of claim 4, wherein the first contour is outside of the dovetail slot edge, and wherein the protrusion part further comprises a protection portion between the blast portion and the shadow portion, the protection portion being shaped to cover an area of the turbine wheel face from the dovetail slot edge to the first contour when the plug is fully inserted into the turbine wheel.

7. The plug of claim 6, wherein an offset from the dovetail slot edge to the first contour is substantially constant.

8. The plug of claim 7, wherein an offset from the first contour to the second contour is substantially constant.

9. The plug of claim 1, further comprising a flange part connected to the insertion part and shaped to cover at least a part of a turbine wheel surface (130) along the predetermined insertion depth.

10. A method to form a plug for insertion into a dovetail slot of a turbine wheel, the method comprising:

forming an insertion part in a shape to be axially inserted into the dovetail slot from a turbine wheel face to a predetermined insertion depth when the plug is fully inserted into the turbine wheel; and forming a protrusion part in a shape to axially protrude from the turbine wheel face when the plug is fully inserted into the turbine wheel, wherein the step of forming the protrusion part comprises:

forming a blast portion connected to the insertion part; and forming a shadow portion on outside of the blast portion such that a first contour of the shadow portion is defined at the turbine wheel face, a second contour of the shadow portion is defined at a predetermined protrusion distance from the turbine wheel face, the second contour being outside of the first contour, a shadow surface is a surface of the shadow portion between the first and second contours, and a shadow angle formed between the shadow surface and the turbine wheel face is less than 90°.

11. The method of claim 10, wherein the step of forming the shadow portion comprises forming the shadow portion such that the shadow angle is substantially constant over an entirety of the shadow surface.

12. The method of claim 10, wherein the step of forming the insertion part comprises forming the insertion part such that an insertion part contour of the insertion part matches a contour of the dovetail slot along at least a part of the predetermined insertion depth.

13. The method of claim 10, wherein the step of forming the shadow portion comprises forming the shadow portion such that the first contour is at or outside dovetail slot edge.

14. The method of claim 13, wherein the step of forming the shadow portion comprises forming the shadow portion such that an offset from the dovetail slot edge to the second contour is substantially constant.

15. The method of claim 13, wherein the step of forming the shadow portion comprises forming the shadow portion such that the first contour is outside of the dovetail slot edge, and wherein the step of forming the protrusion part further comprises forming a protection portion between the blast portion and the shadow portion in a shape to cover an area of the turbine wheel face from the dovetail slot edge to the first contour when the plug is fully inserted into the turbine wheel.

16. The method of claim 15, wherein step of forming the protection portion comprises forming the protection portion such that an offset from the dovetail slot edge to the first contour is substantially constant.

17. The method of claim 16, wherein step of forming the shadow portion comprises forming the shadow portion such that an offset from the first contour to the second contour is substantially constant.

18. The method of claim 10, further comprising forming a flange part connected to the insertion part and in a shape to cover at least a part of a turbine wheel surface along the predetermined insertion depth.

19. A method to apply a protective coating on a turbine wheel, the method comprising:

inserting plugs into dovetail slots of the turbine wheel; and subsequently applying the protective coating on the turbine wheel, wherein each plug comprises:

an insertion part shaped to be axially inserted into the dovetail slot from a turbine wheel face to a predetermined insertion depth when the plug is fully inserted into the turbine wheel, and a protrusion part shaped to axially protrude from the turbine wheel face when the plug is fully inserted into the turbine wheel, wherein the protrusion part comprises:

a blast portion connected to the insertion part, and a shadow portion on outside of the blast portion and shaped such a first contour of the shadow portion is defined at the turbine wheel face, a second contour of the shadow portion is defined at a predetermined protrusion distance from the turbine wheel face, the second contour being outside of the first contour, a shadow surface is a surface of the shadow portion between the first and second contours, and a shadow angle formed between the shadow surface and the turbine wheel face is less than 90°.

20. The method of claim 19, wherein no post processing is performed to profile the protective coating.

* * * * *

UNITED STATES PATENT AND TRADEMARK OFFICE

CERTIFICATE OF CORRECTION

PATENT NO. : 8,869,739 B2
APPLICATION NO. : 13/284535
DATED : October 28, 2014
INVENTOR(S) : Pfaffenroth et al.

It is certified that error appears in the above-identified patent and that said Letters Patent is hereby corrected as shown below:

In the Claims

In Column 7, Line 52, in Claim 9, delete "surface (130)" and insert -- surface --, therefor.

In Column 8, Line 37, in Claim 16, delete "wherein step" and insert -- wherein the step --, therefor.

In Column 8, Line 41, in Claim 17, delete "wherein step" and insert -- wherein the step --, therefor.

Signed and Sealed this
Ninth Day of June, 2015

Michelle K. Lee

Michelle K. Lee
*Director of the United States Patent and Trademark Office*